US008006459B2

(12) United States Patent
Connell et al.

(10) Patent No.: US 8,006,459 B2
(45) Date of Patent: Aug. 30, 2011

(54) SHEAR PLATE

(75) Inventors: Robert Urquhart Connell, Victoria (AU); Andrew Coumaros, Victoria (AU)

(73) Assignee: ITW Construction Systems Australia Pty Ltd, Victoria (AU)

( * ) Notice: Subject to any disclaimer, the term of this patent is extended or adjusted under 35 U.S.C. 154(b) by 0 days.

(21) Appl. No.: 12/439,022

(22) PCT Filed: Aug. 29, 2007

(86) PCT No.: PCT/AU2007/001244

§ 371 (c)(1),
(2), (4) Date: Oct. 4, 2009

(87) PCT Pub. No.: WO2008/025070

PCT Pub. Date: Mar. 6, 2008

(65) Prior Publication Data

US 2010/0011693 A1 Jan. 21, 2010

(30) Foreign Application Priority Data

Aug. 31, 2006 (AU) ..... 2006904746

(51) Int. Cl.
*E04B 1/21* (2006.01)

(52) U.S. Cl. ..... 52/582.1; 52/707; 52/125.5

(58) Field of Classification Search ..... 52/582.1, 52/582.2, 583.1, 707, 715, 124.2, 125.1, 52/125.5, 292, 295

See application file for complete search history.

(56) References Cited

U.S. PATENT DOCUMENTS

| | | | | | |
|---|---|---|---|---|---|
| 1,212,843 | A | * | 1/1917 | Struchen | 52/700 |
| 1,728,981 | A | * | 9/1929 | Ropp | 52/702 |
| 2,724,960 | A | * | 11/1955 | Nelsson | 52/712 |
| 3,033,533 | A | * | 5/1962 | Dieulangard | 165/56 |
| 3,267,624 | A | * | 8/1966 | Wozniak et al. | 52/100 |
| 3,372,523 | A | * | 3/1968 | Hall, Jr. | 52/699 |
| 3,600,868 | A | * | 8/1971 | Wilson et al. | 52/334 |
| 3,671,738 | A | * | 6/1972 | Beachley | 362/431 |
| 3,894,368 | A | * | 7/1975 | Crofoot | 52/105 |
| 4,052,827 | A | * | 10/1977 | Yancey | 52/156 |
| 4,056,878 | A | * | 11/1977 | Woodley | 29/525.11 |

(Continued)

FOREIGN PATENT DOCUMENTS

DE 10060528 A1 6/2002

OTHER PUBLICATIONS

ISR for PCT/AU2007/001244 mailed Sep. 28, 2007.

*Primary Examiner* — Eileen Lillis
*Assistant Examiner* — Alp Akbasli
(74) *Attorney, Agent, or Firm* — Lowe Hauptman Ham & Berner

(57) ABSTRACT

A shear plate for application to the outer end portion of a ferrule to be cast into a concrete component such as a wall panel, the shear plate having an outer portion engageable with the ferrule and, beyond the outer portion, a portion shaped to incline away from the adjacent surface of the concrete component to which the outer end of the ferrule is to be exposed. The shear plate enables the ferrule to be situated close to an edge of the component in a situation in which it will be subjected to shear loading in a direction towards that edge.

10 Claims, 1 Drawing Sheet

U.S. PATENT DOCUMENTS 4,067,168 A * 1/1978 Thurner ..... 52/854
4,079,559 A * 3/1978 Tenbrummeler ..... 52/295
4,503,645 A * 3/1985 Nudd et al. ..... 52/40
4,641,478 A * 2/1987 Nelson, Jr. ..... 52/704
4,665,672 A * 5/1987 Commins et al. ..... 52/295
4,896,985 A * 1/1990 Commins ..... 403/11
5,150,553 A * 9/1992 Commins et al. ..... 52/264
5,222,338 A 6/1993 Hull et al.
5,392,581 A * 2/1995 Hatzinikolas et al. ..... 52/712
5,402,616 A 4/1995 Klein
5,595,031 A * 1/1997 Commins ..... 52/264
5,829,207 A * 11/1998 Mackay Sim et al. ..... 52/125.4
5,885,024 A * 3/1999 Zupan et al. ..... 403/389
6,164,873 A * 12/2000 Miotti et al. ..... 405/267
6,185,897 B1 * 2/2001 Johnson et al. ..... 52/583.1
6,237,300 B1 * 5/2001 Carne et al. ..... 52/715
6,295,780 B1 * 10/2001 Thompson ..... 52/712
6,415,575 B1 * 7/2002 Thompson ..... 52/712
6,510,666 B1 * 1/2003 Thompson ..... 52/712
6,647,674 B1 * 11/2003 Lancelot et al. ..... 52/125.4
6,658,806 B1 * 12/2003 Leek ..... 52/295
6,662,517 B1 * 12/2003 Thompson ..... 52/714
6,668,506 B2 12/2003 Snauwaert
6,877,284 B2 * 4/2005 Thompson ..... 52/112
6,877,291 B2 * 4/2005 Shamroukh et al. ..... 52/702
6,941,717 B2 * 9/2005 Hohmann et al. ..... 52/506.01
7,445,192 B2 * 11/2008 Gridley et al. ..... 249/207
7,448,172 B1 * 11/2008 Knodel ..... 52/98
7,596,917 B2 * 10/2009 Schloemer et al. ..... 52/293.3
2003/0196393 A1 * 10/2003 Bowman et al. ..... 52/295
2004/0040236 A1 3/2004 Adams
2004/0159069 A1 * 8/2004 Hansort ..... 52/698

* cited by examiner

SHEAR PLATE

RELATED APPLICATIONS

The present application is based on International Application Number PCT/AU2007/001244 filed Aug. 29, 2007, and claims priority from Australian Application Number 2006904746 filed Aug. 31, 2006, the disclosures of which are hereby incorporated by reference herein in their entirety.

TECHNICAL FIELD

The present invention relates to a shear plate for a cast-in ferrule.

BACKGROUND

Internally threaded ferrules may be incorporated into a concrete component, such as a wall panel or beam, during casting thereof to provide within the cast component a fixing point for subsequent attachment. The deep embedment of the ferrule within the concrete in conjunction with a transverse tie bar through the inner end of the ferrule and/or an enlarged base portion of the ferrule ensures that the ferrule is firmly anchored against axial loading. Provided the ferrule is sufficiently spaced from the edge of the component, the ferrule is also able to carry a substantial shear loading as a result of the inherent strength of the concrete between the ferrule and the edge of the component. That effect cannot, however, arise if the ferrule is situated relatively close to the edge of the component and in that case, ferrules have not conventionally been used in a situation where it will be subject to a shear loading in a direction towards the adjacent edge.

SUMMARY

According to the present invention there is provided a shear plate for application to the outer end portion of a ferrule to be cast into a concrete component, the shear plate having an outer portion engageable with the ferrule and, beyond the outer portion, a portion shaped to incline away from the adjacent surface of the concrete component to which the outer end of the ferrule is to be exposed.

In a preferred embodiment the outer portion is itself of plate-like form to extend substantially parallel to the said surface of the component. The plate-like portion has an aperture within which the outer end portion of the ferrule is received. The plate-like portion may have a second such aperture longitudinally spaced from the first to receive a second ferrule.

Advantageously, beyond the inclined portion, the plate terminates in a pair of oppositely inclined leg portions to provide for increased anchorage. Alternatively the inclined portion can be formed with one or more apertures for this purpose.

The present invention also provides a cast concrete component having cast therein at least one internally threaded ferrule associated with a shear plate as defined above, the ferrule being installed close to an edge of the component and the shear plate extending away from that edge substantially at right angles thereto.

BRIEF DESCRIPTION OF DRAWINGS

An embodiment of the invention will now be described by way of example only with reference to the accompanying drawings in which.

DETAILED DESCRIPTION

Figure 1:
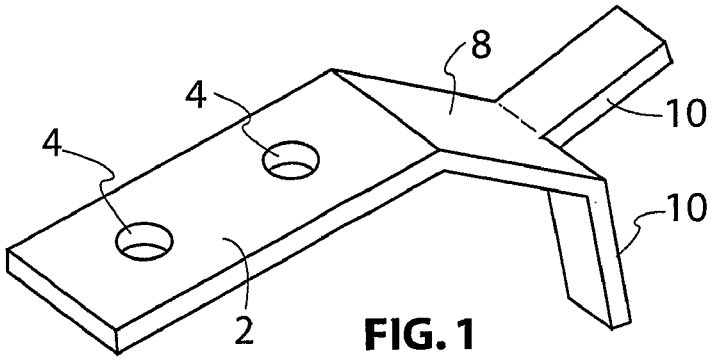
FIG. 1 is a perspective view of a shear plate in accordance with a preferred embodiment of the invention.
Figure 2:
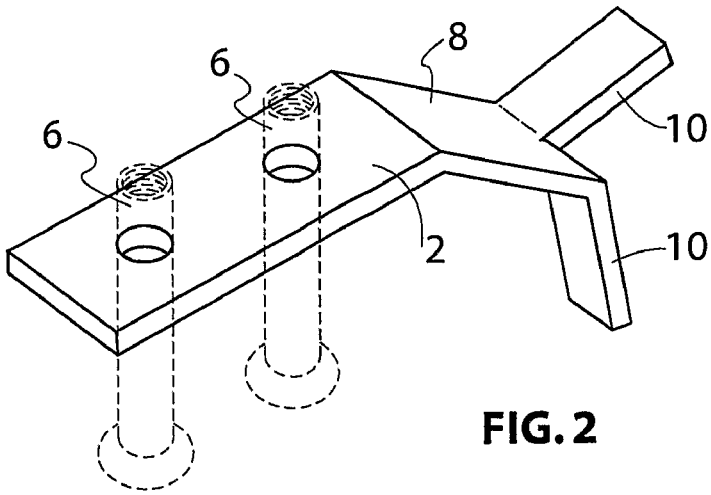
FIG. 2 is a perspective view similar to FIG. 1 but showing a pair of ferrules installed to shear plate.
Figure 3:
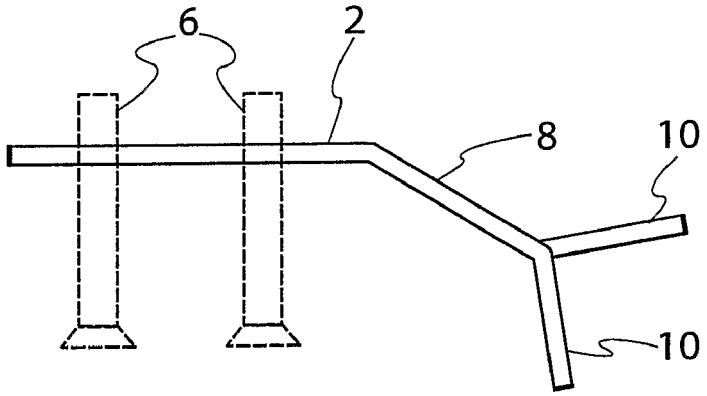
FIG. 3 is a side view.

There is shown in the accompanying drawings a shear plate for application to a ferrule in a situation where it is subject to a shear loading with the ferrule placed relatively close to an edge of a concrete component, a wall panel for example, with the ferrule extending at right angles to a panel surface at right angles to that edge so that the outer end of the ferrule is exposed to the panel surface and thereby the threaded bore of the ferrule opens onto that surface. The shear plate comprises an outer portion 2 adapted to extend parallel to that surface of the concrete component to which the outer end of the ferrule is to be exposed. This portion of the plate is apertured for application over the outer end portion of the ferrule. In the particular embodiment shown the outer portion of the plate is provided with two such apertures 4 longitudinally spaced for engagement over two laterally spaced ferrules 6 for use in situations where two closely spaced fixing points are required in the cast component. However, it will be understood that the shear plate can be used with only a single ferrule and in an alternative version the outer portion 2 of the plate may be formed just with a single aperture 4 and thereby for use with a single ferrule.

Beyond the outer portion 2, the plate is formed with a portion 8 inclined inwardly, that is in a direction away from the surface of the component, to thereby increase the depth of embedment. Beyond the inclined portion 8 the plate is divided into two leg portions 10, one bent upwardly and the other downwardly, for increased anchorage. While the presence of the two divergent leg portions 10 at the remote end of the shear plate is preferred, nevertheless in an alternative version they could be omitted as for some applications the downwardly inclined portion of the shear plate may itself be sufficient to provide the required anchorage under the applied shear loading. In an alternative, the inclined portion could include one or more apertures possibly of elongate shape in which concrete is received during casting in order to increase the anchorage. The aperture(s) can be formed by a punching operation.

The portions 2, 8, 10 of the plate are integrally formed from a metal blank of required length by stamping/pressing, and the aperture(s) 4 is also formed in the same manner.

In use, the shear plate is applied to a ferrule 6 (or a pair of ferrules) located close to the edge of a wall panel or other component, with the shear plate extending away from that edge in a direction at right angles to the edge so that the plate is able to provide shear resistance to shear loading applied to the ferrule(s) in a direction towards that edge.

By the provision of the shear plate the range of possible applications of cast-in ferrules is able to be increased. By way of example only, a pair of ferrules can be installed close to the vertical edge of a wall panel to form anchorage points on the surface of the panel for a connection system for connecting that panel to an adjacent panel in an erected wall structure.

The embodiment has been described by way of example only and modifications are possible within the scope of the invention.

The invention claimed is:

1. A shear plate for application to a ferrule to be case into a concrete component, the shear plate comprising:

an outer portion engageable with the ferrule:

an inclined portion extending obliquely from an end of the outer portion, and a first leg portion extending obliquely from an end of the inclined portion so as to extend further away from the end of the outer portion but toward the plane of the outer portion, wherein the outer portion, the inclined portion and the leg portion are integrally formed in one piece, and a second leg portion extending obliquely from the end of the inclined portion, so to also extend further away from the end of the outer portion and away from the plane of the outer portion.

2. The shear plate according to claim 1, wherein said two leg portions extend substantially perpendicular to each other and are embeddable in the concrete component.

3. A cast concrete panel, comprising:

a concrete component;

a shear plate; and a ferrule at least partially cast in the concrete component and having an outer end exposed at a surface of the concrete component, wherein the shear plate comprising:

an outer portion engaged with the ferrule; and an inclined portion which is embedded within the concrete component and extends obliquely from an end of the outer portion and away from the surface of the concrete component, a first leg portion extending obliquely from an end of the inclined portion so as to extend further away from the end of the outer portion but towards the surface of the concrete component, wherein the first leg portion is entirely embedded in the concrete component; and a second leg portion extending obliquely from an end of the inclined portion so as to extend further away from the end of the outer portion and also away from the surface of the concrete component, wherein said second leg portion is entirely embedded in the concrete component.

4. The concrete panel according to claim 3, wherein the outer portion of the shear plate includes an aperture through which the ferrule extends.

5. The concrete panel according to claim 4, further comprising another ferrule at least partially cast in the concrete component and having an outer end exposed at the surface of the concrete component;

wherein the outer portion has another aperture which is longitudinally spaced from said aperture and through which said another ferrule extends.

6. The concrete panel according to claim 4, wherein the ferrule extends substantially perpendicular to the outer portion of the shear plate.

7. The concrete panel according to claim 6, wherein the outer portion of the shear plate is substantially parallel to the surface of the concrete component.

8. The concrete panel according to claim 3, wherein the inclined portion includes at least one aperture in which concrete of the concrete component is received to provide increased anchorage of the shear plate to the concrete component.

9. The concrete panel according to claim 3, wherein the outer end of the ferrule is hollow and has an internal thread.

10. The concrete panel according to claim 3, wherein the inclined portion, which is embedded within the concrete component, extends continuously and obliquely from the outer portion and away from the surface of the concrete component.

* * * * *